US007174810B1

(12) United States Patent
Lin

(10) Patent No.: US 7,174,810 B1
(45) Date of Patent: Feb. 13, 2007

(54) SELECTIVE ONE-WAY TOOL

(75) Inventor: Jack Lin, Nantou (TW)

(73) Assignee: Yih Cheng Factory Co., Ltd., Nantou City (TW)

( * ) Notice: Subject to any disclaimer, the term of this patent is extended or adjusted under 35 U.S.C. 154(b) by 0 days.

(21) Appl. No.: 11/376,056

(22) Filed: Mar. 15, 2006

(51) Int. Cl.
*B25B 13/46* (2006.01)

(52) U.S. Cl. ..... 81/63.1; 81/59.1; 81/60; 81/436

(58) Field of Classification Search ..... 81/60, 81/63.1, 59.1, 436
See application file for complete search history.

(56) References Cited

U.S. PATENT DOCUMENTS 4,793,222 A * 12/1988 Beugelsdyk ..... 81/63.1
6,370,988 B1 * 4/2002 Thompson et al. ..... 81/63.1
7,036,399 B1 * 5/2006 Gao et al. ..... 81/58.4

* cited by examiner

*Primary Examiner*—Lee D. Wilson
*Assistant Examiner*—Shantese McDonald
(74) *Attorney, Agent, or Firm*—Banger Shia

(57) ABSTRACT

A selective one-way tool includes a handle, a transmission positioned in the slot, a bit-engaging element installed on the handle and a mode-switching ring rotationally installed on the handle. The handle includes a mandrel defining a slot. The transmission includes a first pawl, a second pawl and a spring compressed between the first and second pawls. The bit-engaging element engages with both of the first and second pawls in a non-directional mode, engages with only the first pawl in a first directional mode, and engages with only the second pawl in the second directional mode. The mode-switching ring includes two ribs on an internal side for pushing the second pawl into the slot in the first directional mode, for pushing the first pawl into the slot in the second directional mode, and for not pushing the first and second pawls into the slot in the non-directional mode.

10 Claims, 8 Drawing Sheets

A–A

C–C

SELECTIVE ONE-WAY TOOL

BACKGROUND OF INVENTION

1. Field of Invention

The present invention relates to a selective one-way tool.

2. Related Prior Art

A selective one-way tool can be switched between two modes. In the first mode, the selective one-way tool can only drive a fastener in a first direction. In the second mode, the selective one-way tool can only drive the fastener in the second direction opposite to the first direction. Hence, a user does not have to engage the tool with the fastener, drive the fastener with the tool, disengage the tool from the fastener, and repeat this process for many times before tightening or slackening the fastener to a desired extent. The selective one-way tool can be embodied as a screwdriver such as those shown in Taiwanese Patent Publication Nos. 385742, 403020, 578653 and M241178.

Each of theses screwdrivers includes a complicated structure that includes a mode-switching ring, a pawl and a shaft. When rotated in selective one of two directions, the mode-switching ring moves the pawl to selective one of two positions for engagement with the shaft. When a reacting force is too large for the pawl to bear, skid or skip happens so that the user cannot drive the fastener. Moreover, if unintentionally rotating the mode-switching ring in an undesired one of the directions, the user cannot continue to drive the fastener in a desired direction. This sudden loss of the control over the selective one-way tool entails trouble and inconvenience, and might cause danger.

The present invention is therefore intended to obviate or at least alleviate the problems encountered in prior art.

SUMMARY OF INVENTION

It is the primary objective of the present invention to provide a selective one-way tool that can drive effectively.

According to the present invention, a selective one-way tool includes a handle, a transmission positioned in the slot, a bit-engaging element installed on the handle and a mode-switching ring rotationally installed on the handle. The handle includes a mandrel defining a slot. The transmission includes a first pawl, a second pawl and a spring compressed between the first and second pawls. The bit-engaging element engages with both of the first and second pawls in a non-directional mode, engages with only the first pawl in a first directional mode, and engages with only the second pawl in the second directional mode. The mode-switching ring includes two ribs on an internal side for pushing the second pawl into the slot in the first directional mode, for pushing the first pawl into the slot in the second directional mode, and for not pushing the first and second pawls into the slot in the non-directional mode.

Other objectives, advantages and features of the present invention will become apparent from the following description referring to the attached drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
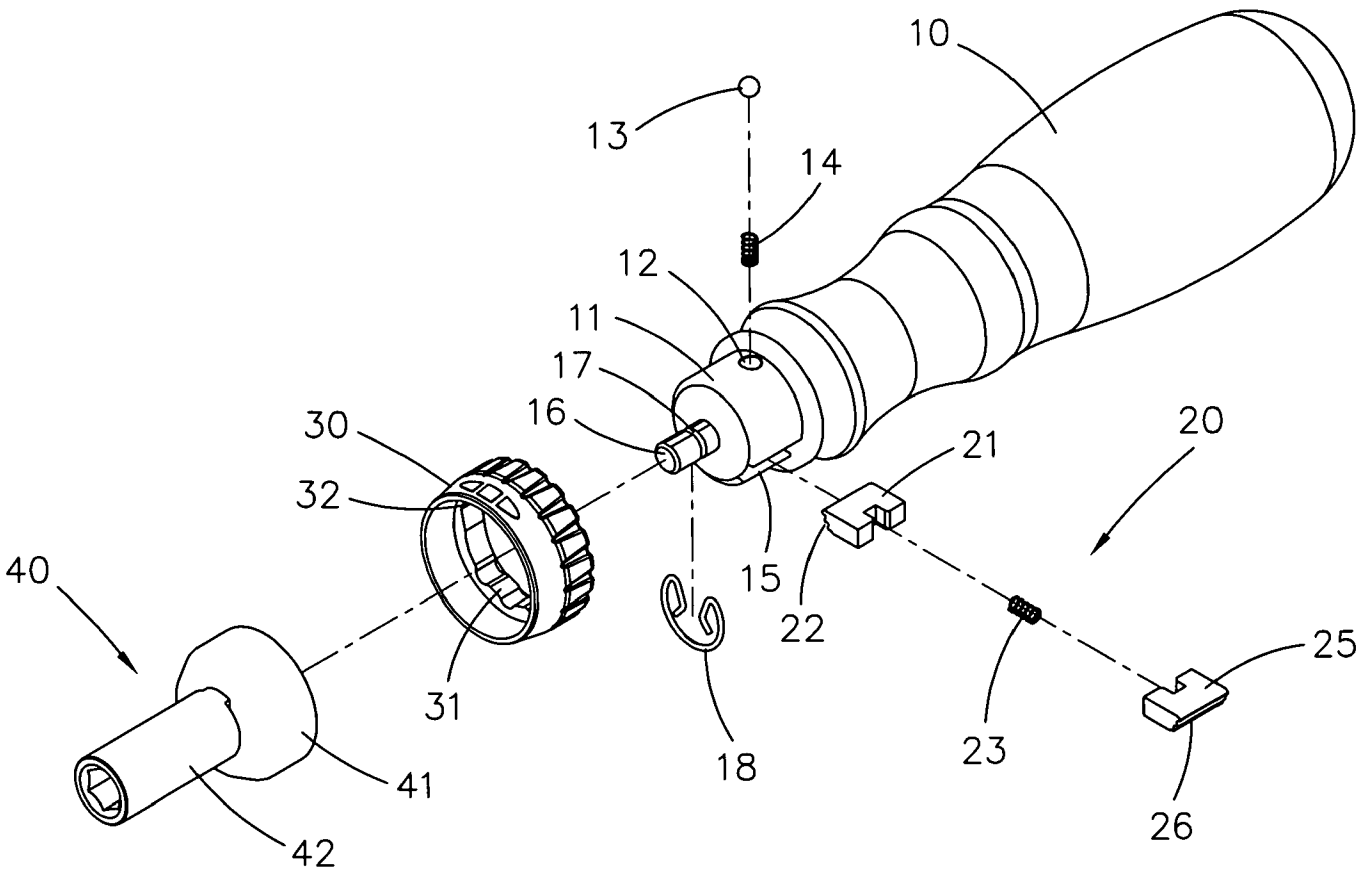
FIG. 1 is an exploded view of a selective one-way tool according to the preferred embodiment of the present invention.
Figure 2:
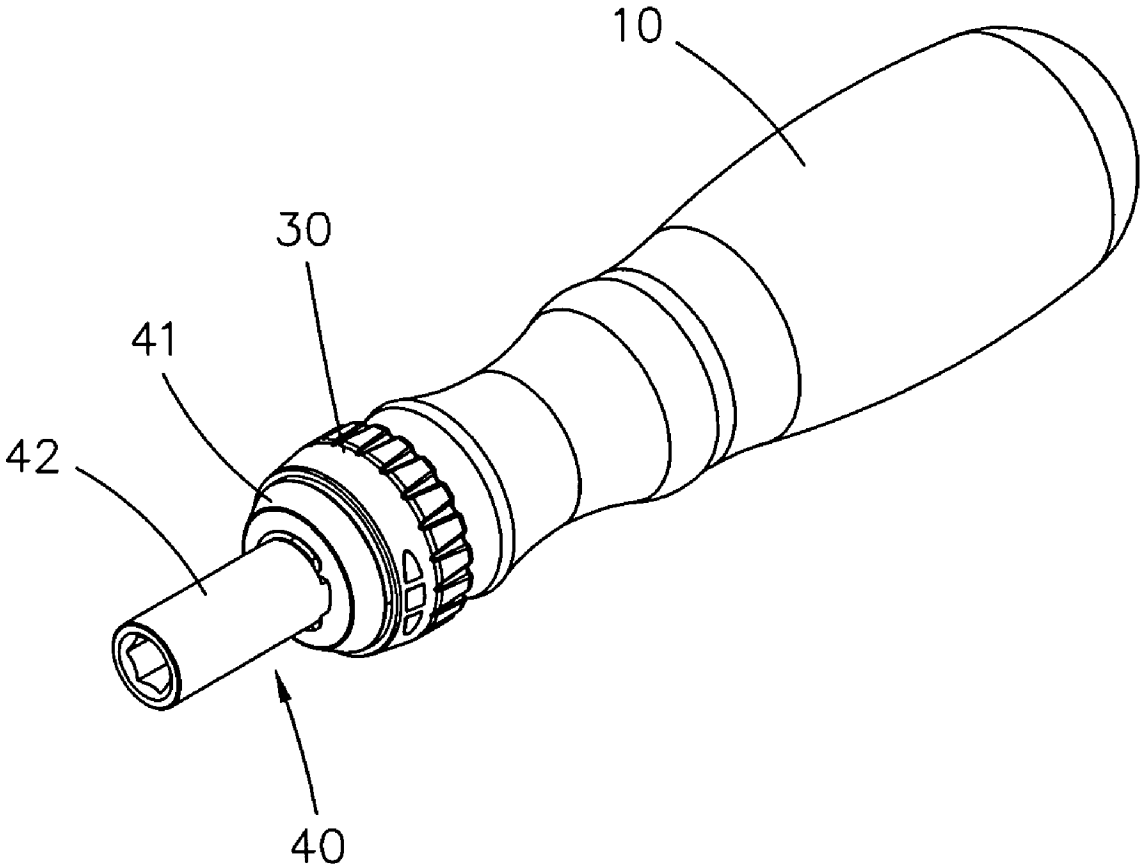
FIG. 2 is a perspective view of the selective one-way tool shown in FIG. 1.

Referring to FIGS. 1 through 3 and 6, there is shown a selective one-way screwdriver according to the preferred embodiment of the present invention. The screwdriver includes a handle 10, a transmission 20, a mode-switching ring 30 and a bit-engaging element 40.

The handle 10 includes a grip to be held by a user, a mandrel 11 for bearing the mode-switching ring 30 and a rod 16 for bearing the bit-engaging element 40. The mandrel 11 extends from the grip. The rod 16 extends from the mandrel 11. The rod 16 is thinner than the mandrel 11. Defined in the periphery of the mandrel 11 is a hole 12 for receiving a spring 14 and a detent 13 biased by the spring 14. The detent 13 is in the form of a ball. Also defined in the periphery of the mandrel 11 is a slot 15 for receiving the transmission 20. Defined in the periphery of the rod 16 is a groove 17 for receiving a clip 18 for retaining the bit-engaging element 40 on the rod 16.

The transmission 20 includes a first pawl 21, a second pawl 25 and a spring 23 compressed between the first pawl 21 and the second pawl 25. The first pawl 21 is formed with teeth 22. The second pawl 25 is formed with teeth 26. The first pawl 21, the second pawl 25 and the spring 23 are positioned in the slot 15 so that the first pawl 21 or the second pawl 25 can be exposed from the slot 15 for engagement with the bit-engaging element 40.

Formed on an internal side of the mode-switching ring 30 are two ribs 31. In a non-directional mode, none of the ribs 31 presses the first pawl 21 or the second pawl 25. In a first directional mode, one of the ribs 31 pushes the second pawl 21 into the slot 15. In a second directional mode, the other rib 31 pushes the first pawl 21 into the slot 15. Defined on an internal side of the mode-switching ring 30 are three recesses 32 corresponding to the first directional mode, the non-directional mode and the second directional mode. Selective one of the recesses 32 can receive the detent 13.

The bit-engaging element 40 includes a first socket 41 and a second socket 42. Formed on an internal side of the first socket 41 are teeth 45 for engagement with the teeth 22 of the first pawl 21 and the teeth 26 of the second pawl 25. The second socket 42 can receive a screwdriver bit. The second socket 42 includes two slots through which two prongs of the clip 18 enter the groove 17 of the rod 16.

Figure 3:
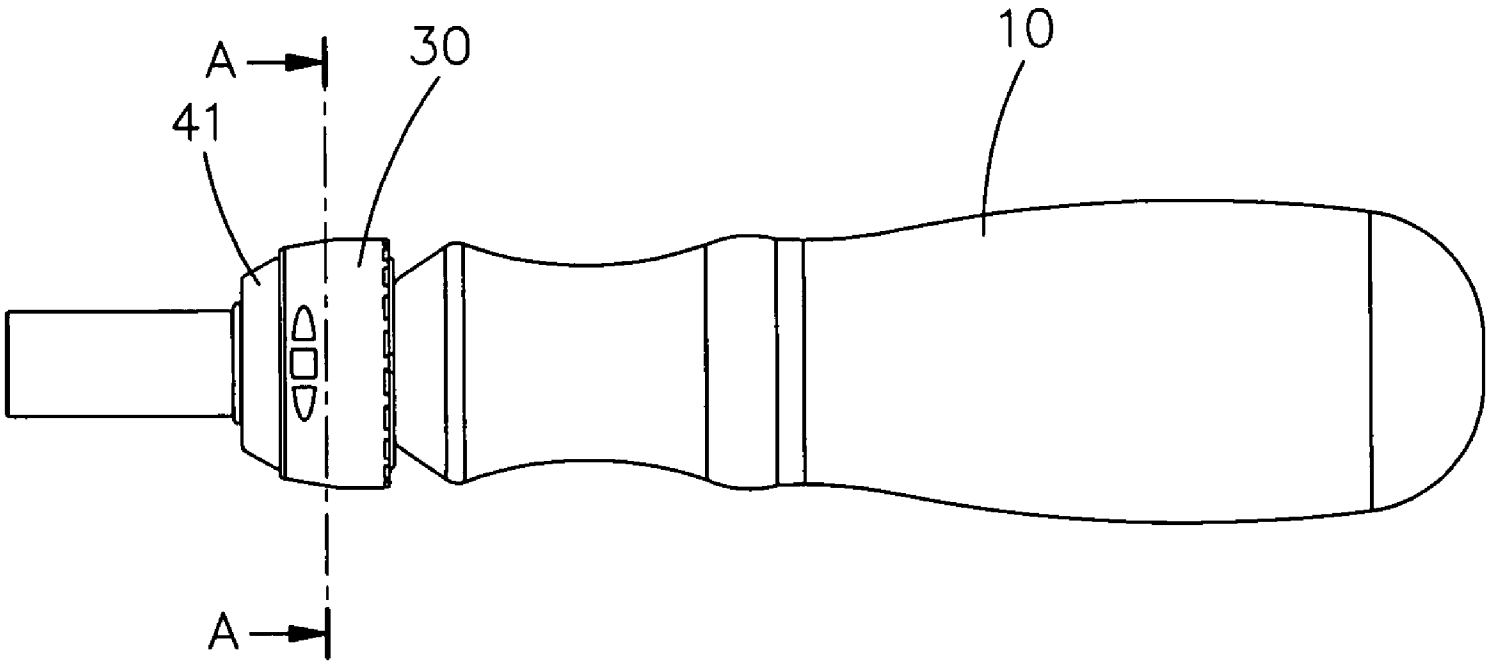
FIG. 3 is a side view of the selective one-way tool shown in FIG. 2 in a neutral mode.
Figure 6:
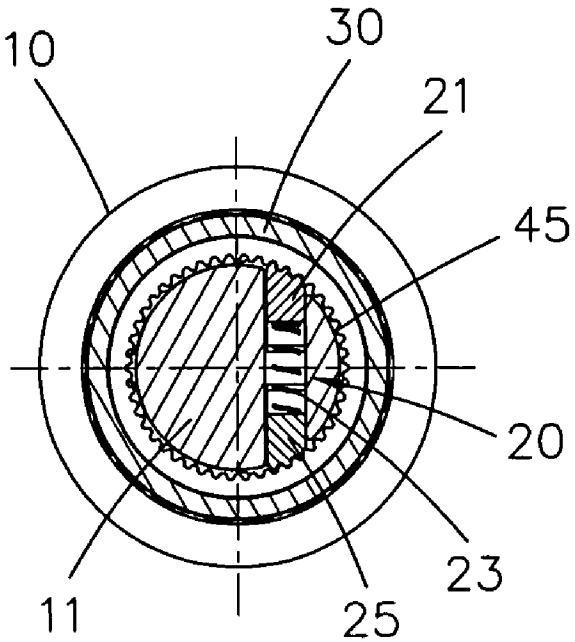
FIG. 6 is a cross-sectional view of the selective one-way tool taken along a line A—A in FIG. 3.

Referring to FIGS. 3 and 6, the selective one-way screwdriver is in the non-directional mode. The teeth 22 of the first pawl 21 and the teeth 26 of the second pawl 25 are in engagement with the teeth 45 of the bit-engaging element 40. A user can drive the screwdriver bit in both of the first and second directions.

Figure 4:
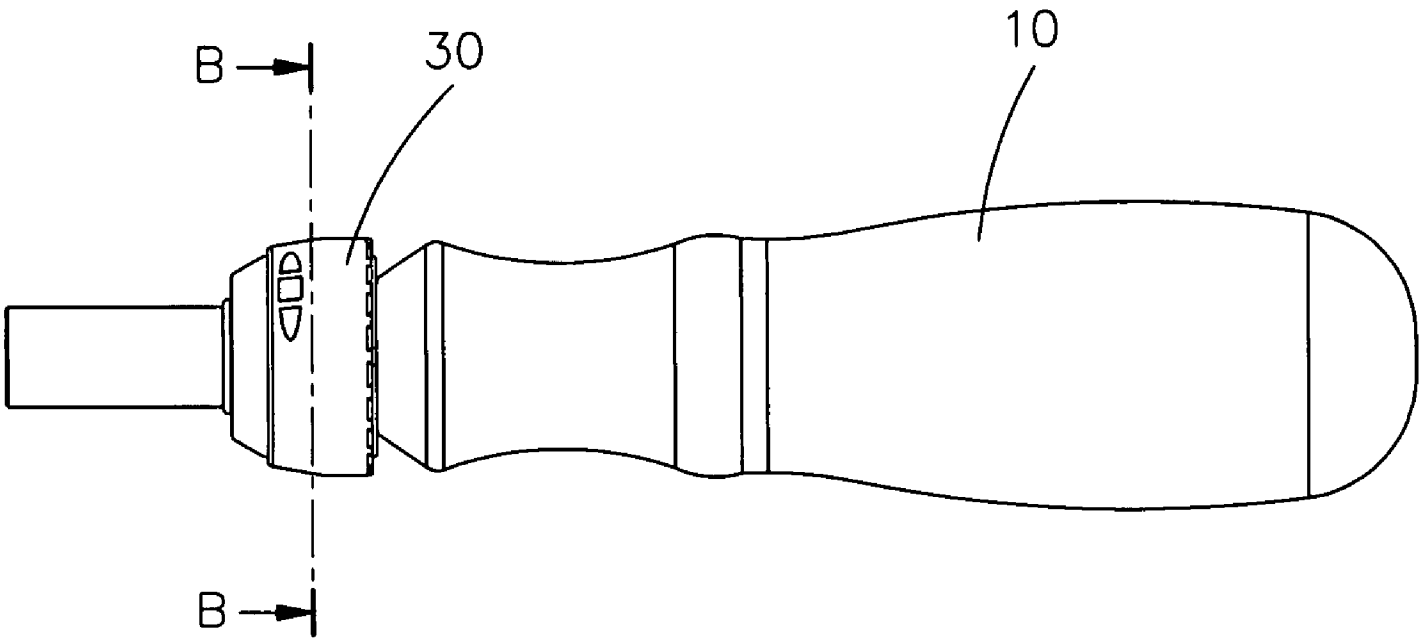
FIG. 4 is a side view of the selective one-way tool shown in FIG. 2 in a first active mode.
Figure 7:
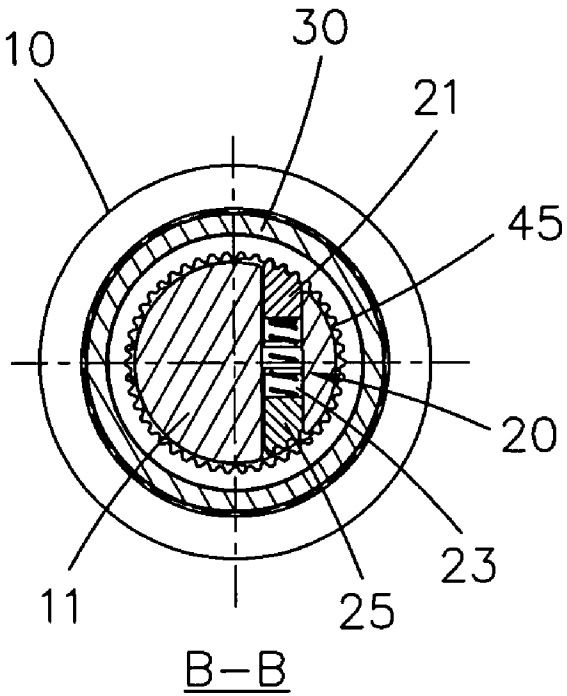
FIG. 7 is a cross-sectional view of the selective one-way tool taken along a line B—B in FIG. 4.

Referring to FIGS. 4 and 7, the selective one-way screwdriver is in the first directional mode. Only the teeth 22 of the first pawl 21 are in engagement with the teeth 45 of the bit-engaging element 40. A user can drive the screwdriver bit in only the first direction.

Figure 5:
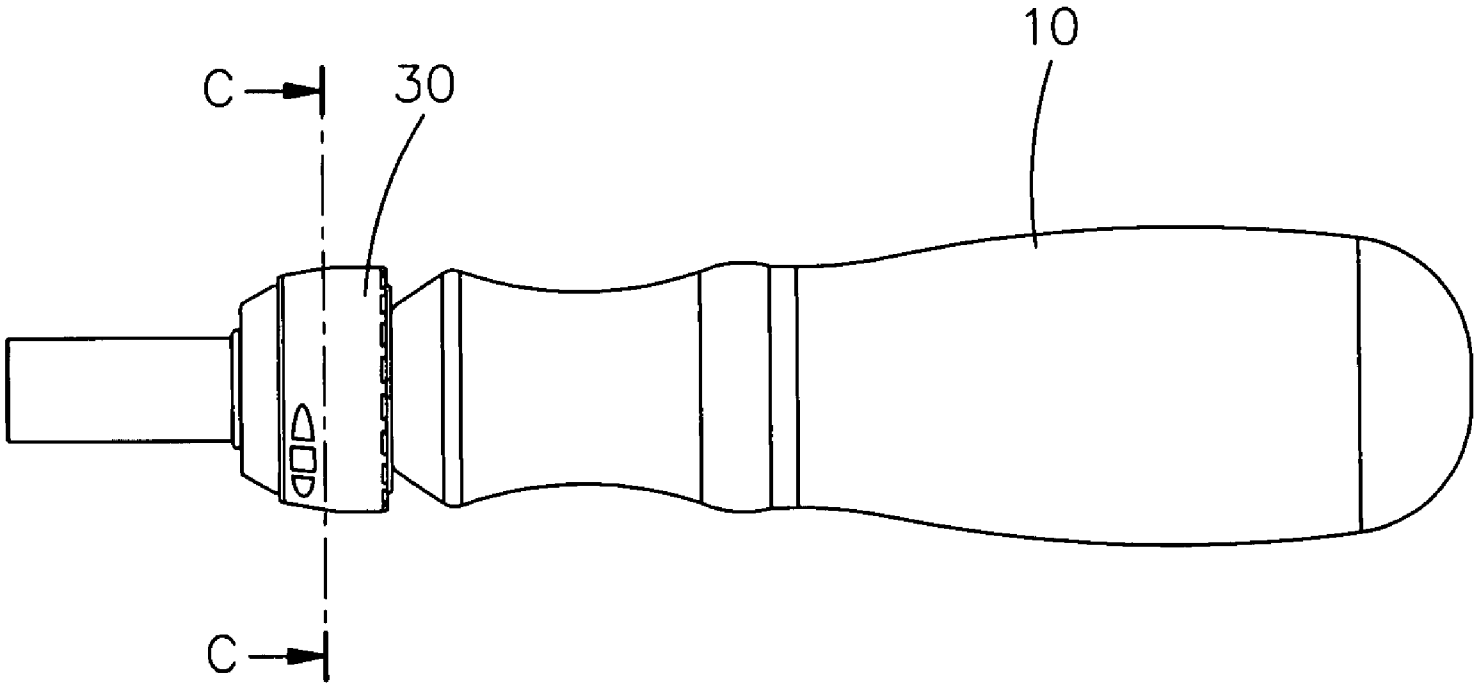
FIG. 5 is a side view of the selective one-way tool shown in FIG. 2 in a second active mode.
Figure 8:
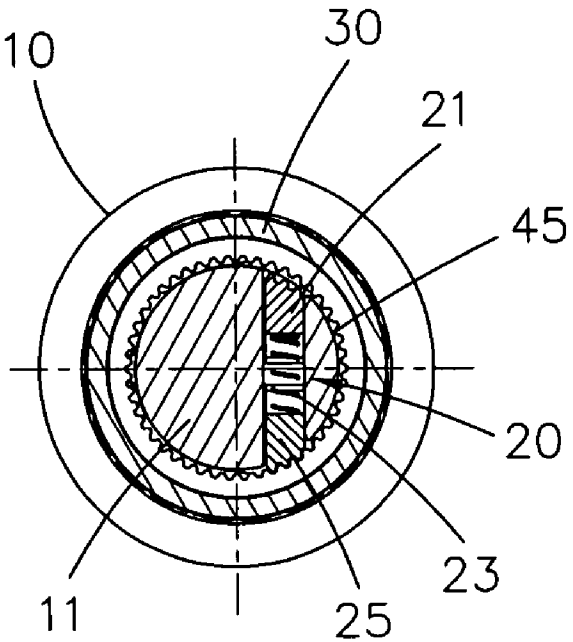
FIG. 8 is a cross-sectional view of the selective one-way tool taken along a line C—C in FIG. 5.

Referring to FIGS. 5 and 8, the selective one-way screwdriver is in the second directional mode. Only the teeth 26 of the second pawl 25 are in engagement with the teeth 45 of the bit-engaging element 40. A user can drive the screwdriver bit in only the second direction.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A selective one-way tool comprising:

a handle comprising a mandrel defining a slot;

a transmission positioned in the slot, the transmission comprising a first pawl, a second pawl and a spring compressed between the first and second pawls;

a bit-engaging element installed on the mandrel for engagement with both of the first and second pawls in a non-directional mode, for engagement with only the first pawl in a first directional mode, and for engagement with only the second pawl in the second directional mode; and a mode-switching ring rotationally installed on the mandrel, the mode-switching ring comprising two ribs on an internal side for pushing the second pawl into the slot in the first directional mode, for pushing the first pawl into the slot in the second directional mode, and for not pushing the first and second pawls into the slot in the non-directional mode.

2. The selective one-way tool according to claim 1 wherein the bit-engaging element comprises teeth on an internal side, wherein both of the first and second pawls comprises teeth for engagement with the teeth of the bit-engaging element.

3. The selective one-way tool according to claim 1 wherein the bit-engaging element comprises:

a first socket for receiving the mandrel and engaging with the first and second detent; and a second socket for receiving a bit.

4. The selective one-way tool according to claim 3 wherein the handle comprises a rod extending from the mandrel into the second socket.

5. The selective one-way tool according to claim 4 comprising a clip for retaining the second socket on the rod.

6. The selective one-way tool according to claim 5 wherein the rod comprises a groove for receiving the clip through slots defined in the second socket.

7. The selective one-way tool according to claim 1 comprising a detent elastically installed on the mandrel, wherein the mode-switching ring comprises, on an internal side, three recesses for receiving the detent corresponding to the modes.

8. The selective one-way tool according to claim 7 wherein the detent is in the form of a ball.

9. The selective one-way tool according to claim 7 comprising a spring compressed between the detent and the mandrel.

10. The selective one-way tool according to claim 9 wherein the mandrel comprises a hole for receiving the spring and the detent.

* * * * *